US006554627B1

(12) United States Patent
Chen

(10) Patent No.: US 6,554,627 B1
(45) Date of Patent: Apr. 29, 2003

(54) ELECTRONIC CARD CONNECTOR AND METHOD FOR ASSEMBLING SAME

(75) Inventor: Ming-Ching Chen, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/101,299

(22) Filed: Mar. 18, 2002

(30) Foreign Application Priority Data

Dec. 26, 2001 (TW) ..... 90132398

(51) Int. Cl.[7] ..... H01R 13/62
(52) U.S. Cl. ..... 439/159
(58) Field of Search ..... 439/188, 159, 439/328, 131, 310, 911; 361/754, 75

(56) References Cited

U.S. PATENT DOCUMENTS 5,507,658 A * 4/1996 Ho ..... 361/157
6,039,238 A * 3/2000 Panaghe ..... 219/541
6,042,402 A * 3/2000 Tung et al. ..... 439/159
6,071,135 A * 6/2000 Obara ..... 439/159
6,113,403 A * 9/2000 Oguchi ..... 439/155
6,115,244 A * 9/2000 Chen et al. ..... 361/680
6,139,340 A * 10/2000 Niitsu ..... 439/159
6,146,164 A * 11/2000 Tung ..... 439/159
6,155,853 A * 12/2000 Kajiura ..... 439/159
6,160,717 A * 12/2000 Desousa et al. ..... 361/754
6,261,113 B1 * 7/2001 Chen ..... 439/260
6,319,028 B1 * 11/2001 Zhang et al. ..... 439/159

* cited by examiner

*Primary Examiner*—Lynn D. Feild
*Assistant Examiner*—Phuong Dinh
(74) *Attorney, Agent, or Firm*—Wei Te Chung

(57) ABSTRACT

An electronic card connector includes an insulative housing (1), a card ejection mechanism (2), a contact module (3), and a detecting device (4) for detecting whether an electronic card is fully inserted into the connector. The housing defines a receiving cavity (10) for accommodating the ejection mechanism at a position adjacent a lateral side of the housing. The ejection mechanism includes a guiding structure (20), a lid (22), a slide rod (24), a slide block (26), an elastic element (27) and a retaining assembly (28). The guiding structure is formed in the housing. The guiding structure includes a recess (201) and an arcuate island (200) formed in a middle of the recess. An end (244) of the slide rod is slidably fitted in the recess. The contact module includes two contact elements (31, 32) mounted end-to-end in the housing.

19 Claims, 6 Drawing Sheets

ELECTRONIC CARD CONNECTOR AND METHOD FOR ASSEMBLING SAME

CROSS-REFERENCE TO RELATED APPLICATION

This application is a co-pending application of patent application Ser. No. 10/101,292 filed on Mar. 18, 2002, entitled CARD EJECTION MECHANISM FOR ELECTRONIC CARD CONNECTOR, invented by the same inventor and assigned to the same assignee of this application, and filed on the same date. The disclosure of the related application is wholly incorporated herein by reference.

BACKGROUND OF THE INVENTION

1. Field of the Invention

The present invention relates to electronic card connectors and assembly thereof, and more specifically to electronic card connectors and methods for assembling electronic card connectors.

2. Prior Art

As electronics technology advances, electronic cards are being more widely used with electronic devices such as mobile phones, personal computers, notebooks, and personal digital assistants (PDAs). Electronic card connectors are adapted to connect electronic cards with the electronic devices, so that processing units in the devices can access information stored in the electronic cards.

A conventional electronic card connector includes an upper housing, a lower housing engaging with the upper housing by snap fastening, and a contact module having six contacts positioned side-by-side in the connector. To facilitate ejection of the electronic card, the connector further includes a card ejection mechanism. The card ejection mechanism generally has a heart-shaped configuration.

An example of a conventional electronic card connector is disclosed in Japan Patent Application No. 2000-2664. With reference to FIG. 1, the conventional electronic card connector comprises an upper housing (not shown), a lower housing 14', a plurality of contacts (not shown), and a card ejector 2'. The card ejector 2' includes a spring 27', a slide arm 26', and a slide lever 24' attached to the slide arm 26'. A heart-shaped block 200' and a corresponding heart-shaped groove 201' surrounding the block 200' are formed in the slide arm 26'. The block 200' has a pit portion 203' and a tip portion 202'. The slide lever 24' has an upper end 242' and a lower end 244'. In operation of the ejector, the lower end 244' of the slide lever 24' slides in the groove 201'. When an electronic card (not shown) is fully inserted into the connector, the lower end 244' engages in the pit portion 203'. When the slide arm 26' is pushed, the lower end 244' exits the pit portion 203', and the spring 27' pushes the slide arm 26' rearward to drive the inserted card to also move rearward. Thus, the inserted card is ejected from the connector.

To assemble the two housings of the conventional electronic connector is laborious and complicated. Additionally, the contacts are positioned side-by-side. Therefore the connector has a relatively large width. This goes against the modem trend toward miniaturization of electronic devices. Finally, the heart-shaped block 200' and the corresponding heart-shaped groove 201' in the slide arm 26' cannot effectively position the slide lever 24' in a desired position. Therefore the heart-shaped block 200' and the heart-shaped groove 201' occupy a relatively large width.

An improved electronic card connector is desired to overcome the above-mentioned problems of the prior art.

SUMMARY OF THE INVENTION

An object of the present invention is to provide an electronic card connector which has an simple structure and provides stable engagement between an electronic card and the connector.

Another object of the present invention is to provide a method for assembling an electronic card connector that has an simple structure and provides stable engagement between an electronic card and the connector.

To accomplish the above-mentioned objects, an electronic card connector of the present invention comprises an insulative housing, a card ejection mechanism, a contact module, and a detecting device for detecting whether an electronic card is fully inserted into the connector. The housing defines a receiving space therein for receiving the card, and further defines a receiving cavity for accommodating the ejection mechanism at a position adjacent a lateral side of the housing. The ejection mechanism includes a guiding structure, a lid, a slide rod, a slide block, an elastic element and a retaining assembly. The guiding structure is formed in the housing. The guiding structure includes a recess and an arcuate island formed in a middle of the recess. An end of the slide rod is slidably fitted in the recess. The contact module includes two contact elements mounted end-to-end in the housing. Each contact element has three contacts. The detecting device comprises two contacts for detecting whether the card is fully inserted into the connector.

Further objects and advantages of the present invention will become more apparent from a consideration of the drawings and the following detailed description.

DETAILED DESCRIPTION OF THE PREFERRED EMBODIMENT

Figure 1:
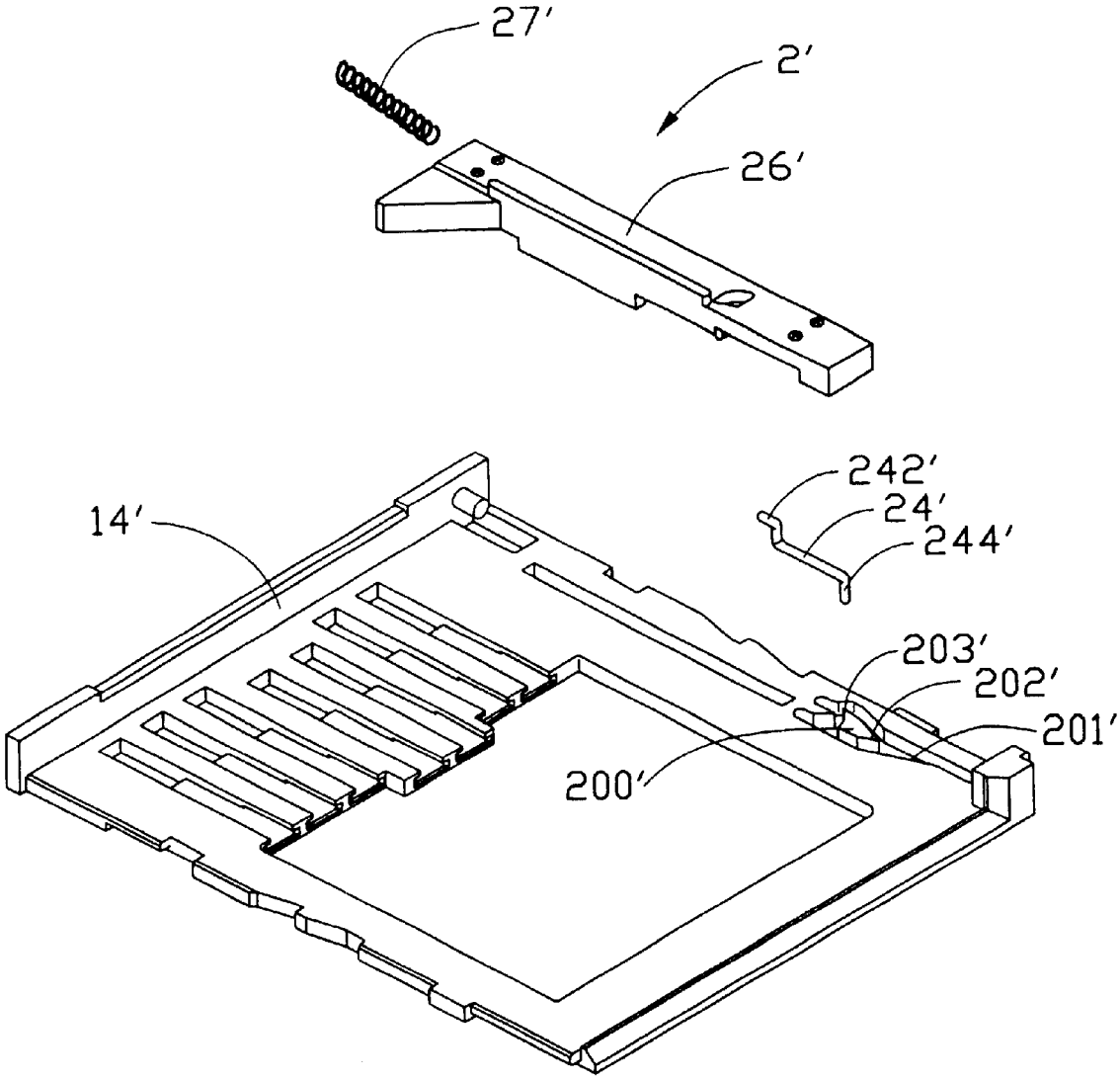
FIG. 1 (PRIOR ART)
FIG. 1 is an exploded perspective view of part of a conventional electronic connector.
Figure 2:
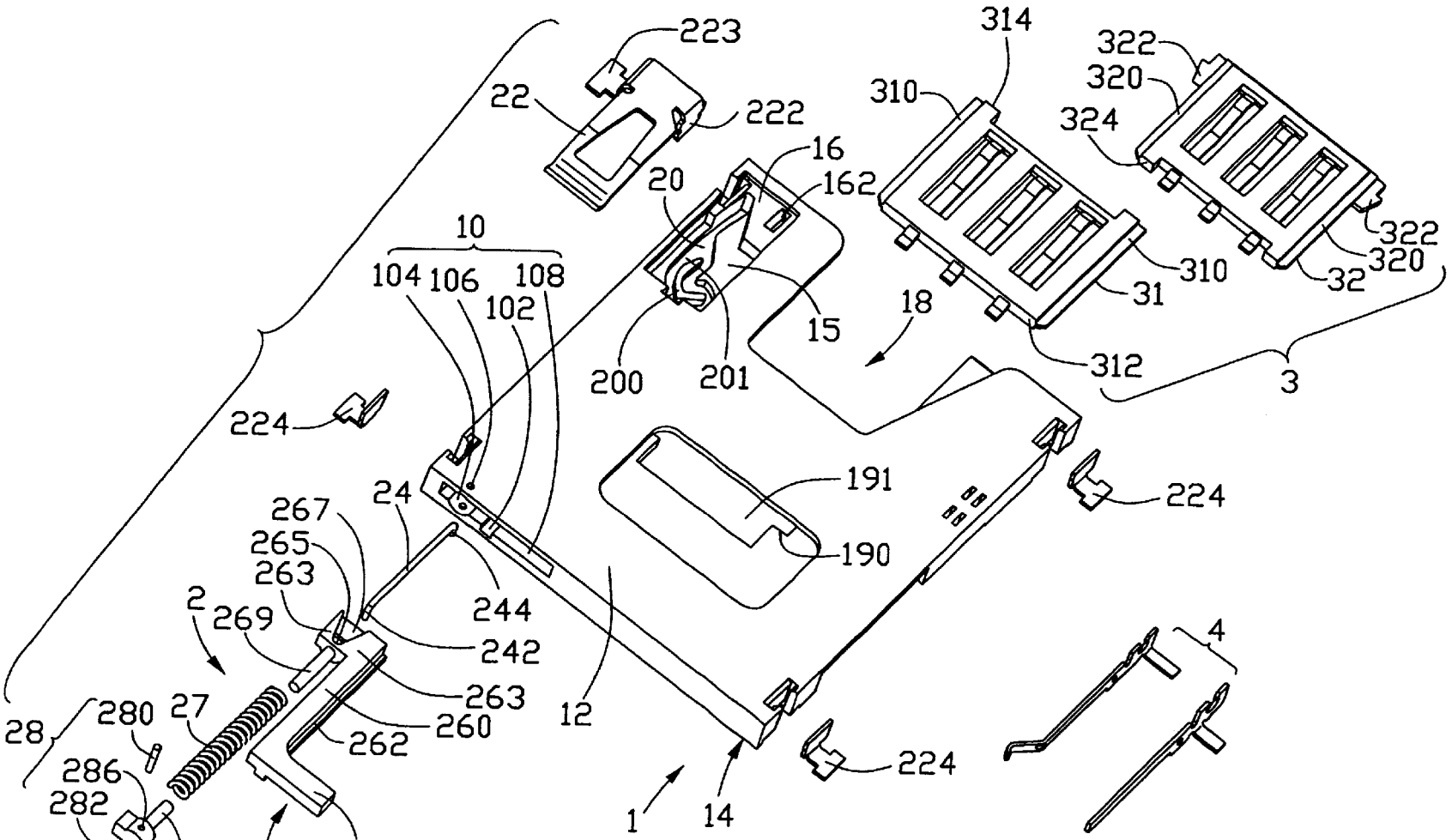
FIG. 2 is an exploded perspective view of an electronic card connector in accordance with the present invention.
Figure 3:
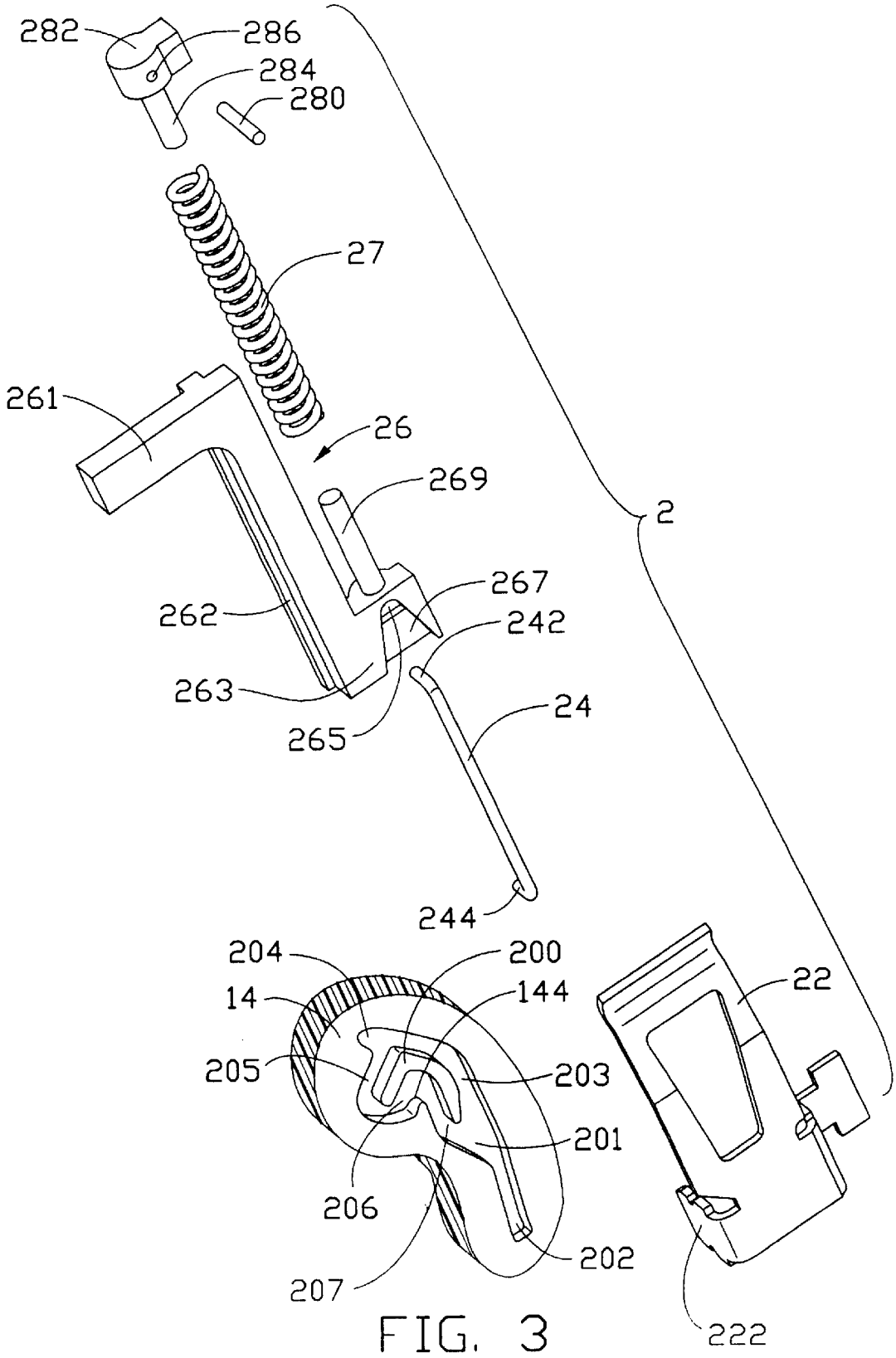
FIG. 3 is an exploded perspective view of a card ejection mechanism of the electronic card connector of FIG. 2.

The present invention will now be introduced in detail by referring to the accompanying drawings. Referring to FIGS. 2 and 3, an electronic card connector in accordance with the present invention comprises an insulative housing 1, a card ejection mechanism 2, a contact module 3, and a detecting device 4 for detecting whether an electronic card (not shown) is fully inserted into the connector.

Figure 6:
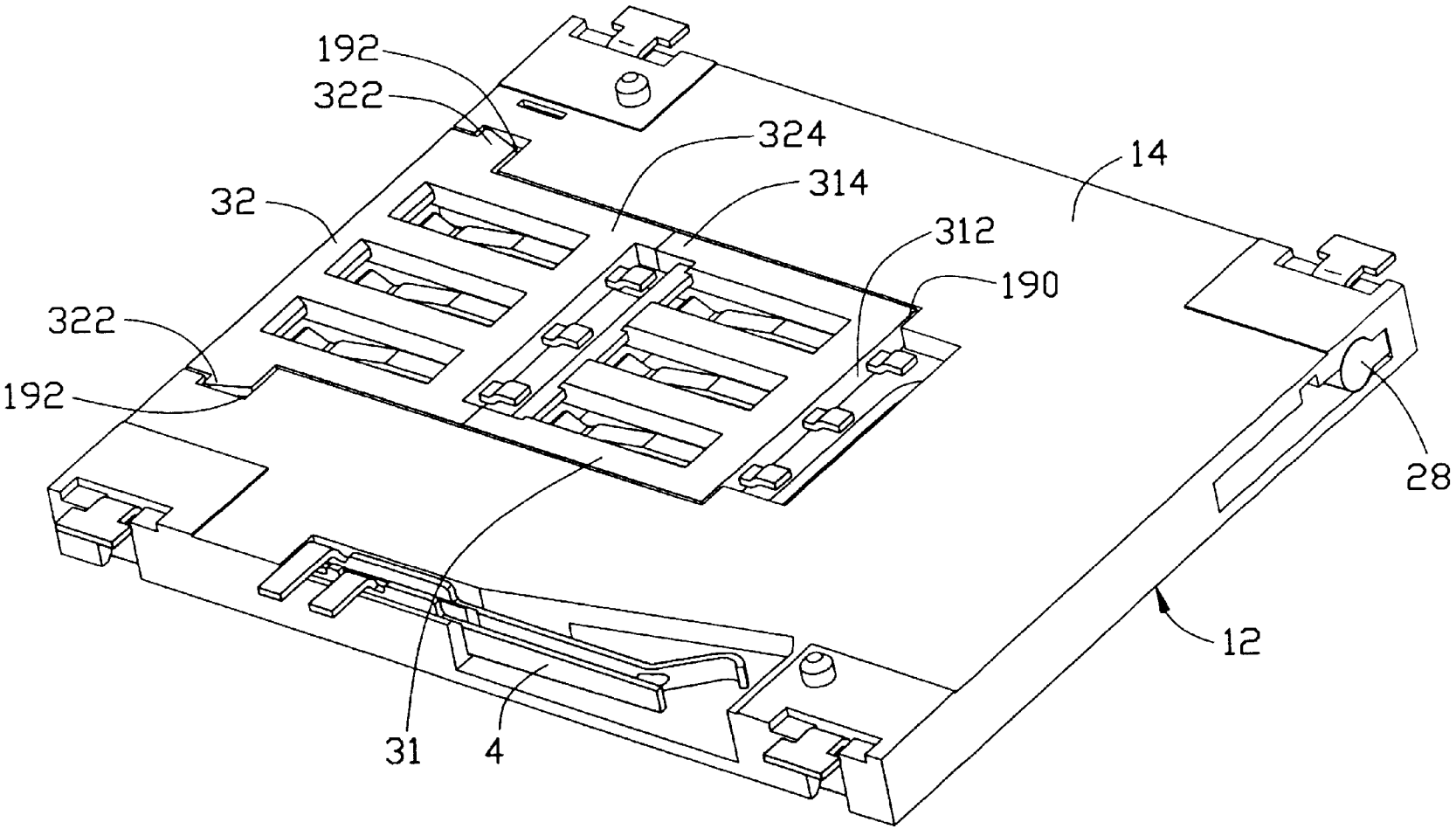
FIG. 6 is electronicilar to FIG. 5, but viewed from a bottom aspect.

Referring also to FIG. 6, the housing 1 comprises a top wall 12, a bottom wall 14, a receiving cavity 10, a top opening 15, and a receiving space 18 for receiving an electronic card. The top opening 15 is defined in a corner of the top wall 12. A stage 16 is formed in the top opening 15. A slot 162 is defined in the stage 16. A bottom opening 191 is defined in a middle portion of the bottom wall 14, for receiving the contact module 3. A pair of steps 190 is formed in the bottom wall 14 at opposite lateral sides respectively of a rear portion of the bottom opening 191. A pair of recesses 192 is defined in the bottom wall 14 at opposite lateral sides respectively of a front portion of the bottom opening 191, and in communication with the bottom opening 191. The receiving cavity 10 is for accommodating the ejection mechanism 2 at a position adjacent a lateral side of the housing 1. The receiving cavity 10 comprises a guiding groove 102, a first receiving groove 104, a first through hole 106, and a second receiving groove 108. The first through hole 106 is defined in the housing 1 above and below the first receiving groove 104, and in communication with the first receiving groove 104.

The ejection mechanism 2 includes a guiding structure 20, a lid 22, a slide rod 24, a slide block 26, an elastic element 27, and a retaining assembly 28.

The guiding structure 20 is formed in the bottom wall 14 of the housing 1. The guiding structure 20 includes a recess 201 defined in the bottom wall 14, and an arcuate island 200 formed in a middle of the recess 291. In this embodiment, the recess 201 has a generally sea horse shaped contour. In cooperation with the island 200, the recess 201 comprises the following portions: a tail portion 202, a back portion 203, a top portion 204, a face portion 205, a jaw portion 206, and an abdomen portion 207. The top portion 204 is disposed between and in communication with the back portion 203 and the face portion 205. The bottom wall 14 also forms a protrusion 144 protruding into the jaw portion 206 adjacent the abdomen portion 207 and opposite the island 200.

The lid 22 is used to cover the guiding structure 20 when they are assembled into the housing 1. The lid 22 includes a position tab 222 for inserting into the slot 162 of the housing 1, and a solder pad 223 for soldering to a printed circuit board (PCB) on which the connector is mounted. Three independent solder pads 224 are for mounting to lateral sides of the housing 1.

The slide rod 24 has a first end 242 and a second end 244. Both ends 242, 244 are bent downwardly, with the second end 244 being for movably fitting in the recess 201 of the housing 1.

The slide block 26 has a generally Z-shaped configuration. The slide block 26 includes a support arm 260 forming a flange 262, a resisting arm 261 perpendicularly extending from a rear end of the support arm 260 in a first direction, and a fixing arm 263 perpendicularly extending from a front end of the support arm 260 in a second direction that is opposite to the first direction. A fixing opening 265 is defined in the fixing arm 263, and a fixing portion 267 of the fixing arm 263 is thus formed adjacent the fixing opening 265. A first engaging pin 269 extends rearward from the fixing arm 263, parallel to the support arm 260.

The elastic element 27 is preferably a helical compression spring, a front end of which is for engaging with the first engaging pin 269 of the slide block 26.

The retaining assembly 28 is used to fix the ejection mechanism 2 in the housing 1. The retaining assembly 28 includes a locking pin 280, a base portion 282 defining a second through hole 286, and a second engaging pin 284 for engaging with a rear end of the elastic element 27.

The contact module 3 includes first and second contact elements 31, 32. Each contact element 31, 32 have three contacts (not labeled) for transmitting electronic signals between an electronic card inserted into the connector and a mainframe incorporating the connector. The first contact element 31 includes a pair of first lateral fins 310, a first rear portion 312 and a front portion 314. The second contact element 32 includes a pair of second lateral fins 320, a pair of protrusions 322 formed at front ends of the second lateral fins 320 respectively, and a second rear portion 324. The detecting device 4 comprises two contacts for detecting whether the electronic card is fully inserted into the connector. The detecting device 4 is conventional, and further description thereof is omitted herefrom for brevity.

Figure 4:
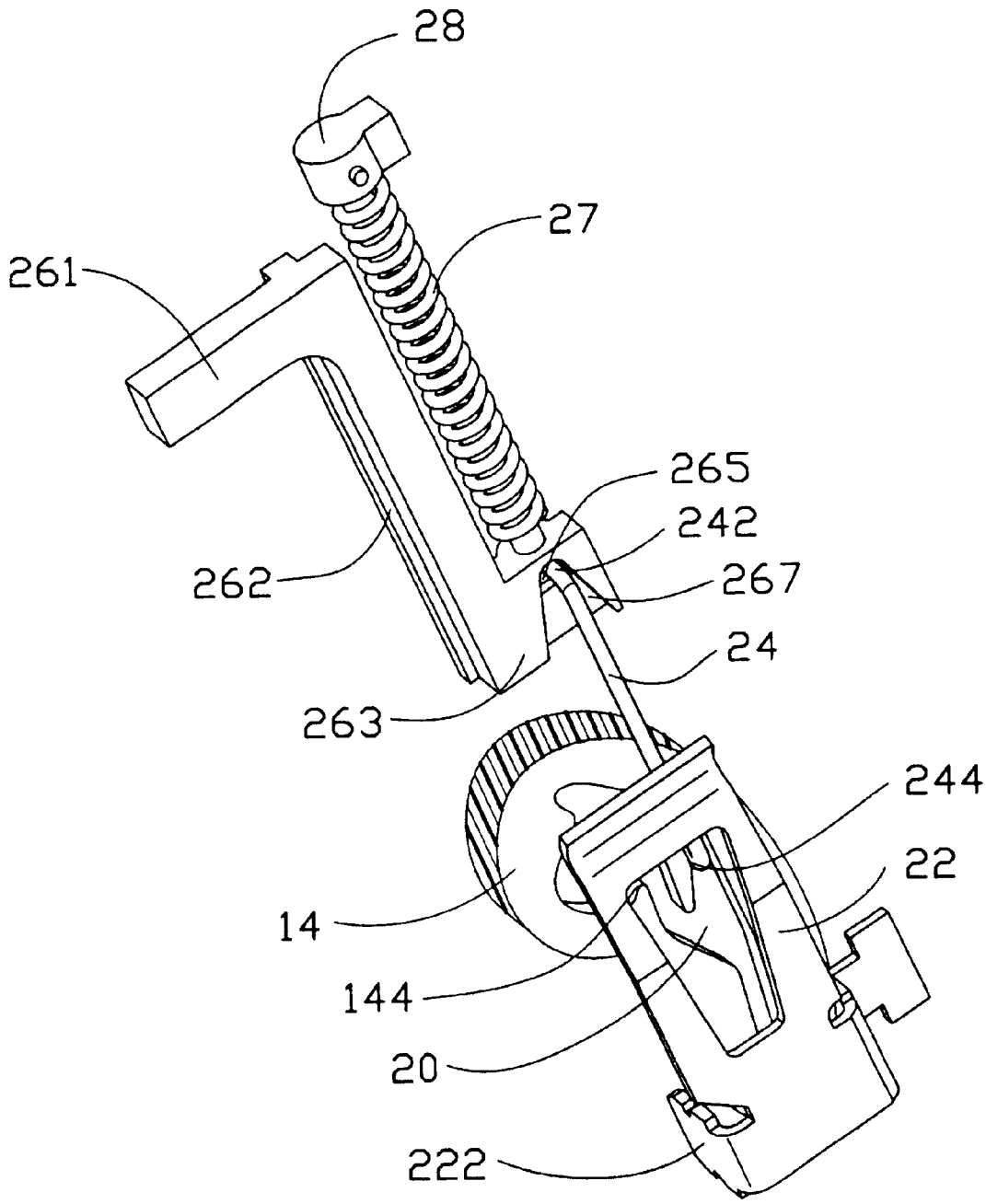
FIG. 4 an assembled view of FIG. 3.
Figure 5:
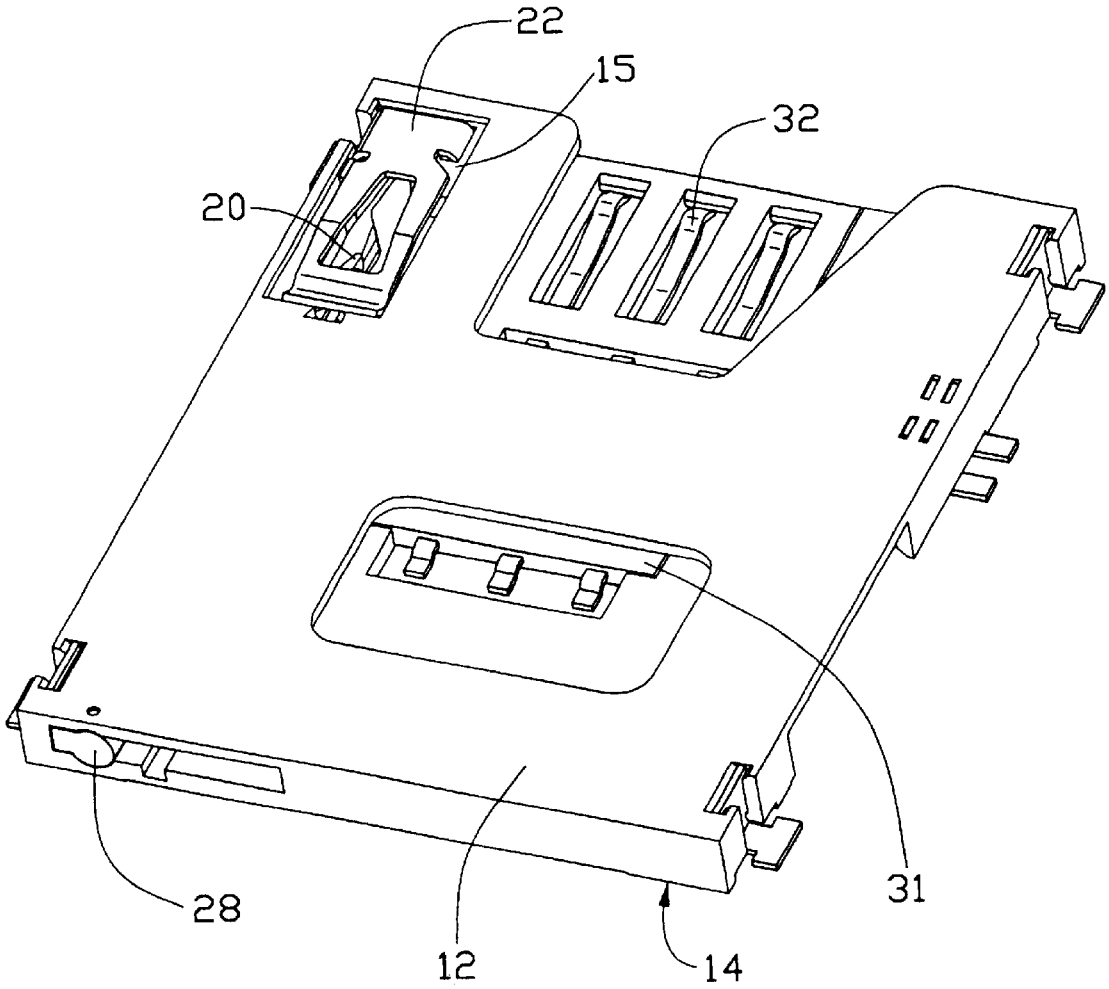
FIG. 5 is an assembled perspective view of the electronic card connector of FIG. 2.

Referring to FIGS. 4–6, the connector is assembled as follows:

(1) The front end of the elastic element 27 is brought to engage with the first engaging pin 269 of the slide block 26. The first end 242 of the slide rod 24 is securely fitted into the fixing opening 265 to engage with the fixing portion 267 of the slide block 26.

(2) The elastic element 27, the slide block 26 and the slide rod 24 are inserted into the receiving cavity 10 of the housing 1. The flange 262 of the support arm 260 slidably engages in the guiding groove 102 of the receiving cavity 10, and the resisting arm 261 fits in the second fixing groove 108 of the receiving cavity 10. The rear end of the elastic element 27 is brought to engage with the second engaging pin 269 of the retaining assembly 28. The retaining assembly 28 is fitted in the first fixing groove 104. The first through hole 106 of the receiving cavity 10 is aligned with the second through hole 286 of the retaining assembly 28. The locking pin 280 of the retaining assembly 28 is fixedly inserted into the first and second through holes 106, 286. The ejection mechanism 2 is thus mounted into the housing 1.

(3) The position tab 222 of the lid 22 is inserted into the slot 162 of the stage 16 of the housing 1. The lid 22 is thus fixed in the top opening 15, and covers the guiding structure 20 to prevent the slide rod 24 from escaping from the housing 1. The solder pad 223 is ready for soldering to the PCB on which the connector is mounted. The three independent solder pads 224 are mounted to lateral sides of the housing 1.

(4) The contact module 3 is mounted into the housing 1. The first lateral fins 310 of the first contact element 31 are fitted into grooves (not shown) defined in the bottom wall 14 of the housing 1 on opposite sides respectively of the bottom opening 191. The first rear portion 312 of the first contact element 31 abuts against the steps 190 of the housing 1. The second contact element 32 is located in front of the first contact element 31. The second lateral fins 320 of the second contact element 32 are fitted into the grooves (not shown) of the bottom wall 14. The second rear portion 324 of the second contact element 32 abuts against the first front portion 312 of the first contact element 31. The protrusions 322 of the second contact element 32 are securely engaged in the recesses 192 of the bottom wall 14.

(5) Finally, the detecting device 4 is assembled into the housing 1 as clearly shown in FIG. 6.

In operation, when the electronic card is not inserted into the connector, the second end 244 of the slide rod 24 is retained in the tail portion 202 of the recess 201 of the housing 1. When the electronic card is inserted, the resisting arm 261 is pushed inwardly, the slide block 26 drives the second end 244 to slide in the recess 201, and the elastic element 27 is compressed. The second end 244 slides in a same direction along the recess 201 past the back portion 203 and to the top portion 204. Subsequently the second end 244 slides past the face portion 205 and into the jaw portion 206. When the electronic card is fully inserted, the second end 244 resiliently presses against the protrusion 144. When the electronic card is ejected, the electronic card is manually pushed slightly forward. The ejection mechanism 2 releases the compression of the elastic element 27. The slide block 26 is moved forwardly. The second end 244 is freed from the protrusion 144, and slides past the abdomen portion 207 to the tail portion 202. The second end 244 thus returns to its original position retained in the tail portion 202.

In the connector according to the present invention, the protrusion 144 effectively prevents the second end 244 from accidentally escaping from the housing 1. In addition, because the recess 201 of the guiding structure 20 has a sea horse shaped contour, the guiding structure 20 occupies relatively little space. Furthermore, the contact elements 31, 32 of the contact module 3 are mounted in the housing 1 end-to-end rather than side-by-side. Thus the contact module 3 occupies a minimal width in the housing 1. Moreover, the housing 1 is formed as a single piece. Therefore manufacturing of the housing 1 and assembly of the connector are convenient and inexpensive.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electronic card connector adapted to electrically connect an electronic card to a printed circuit board, comprising:

a housing defining a receiving space therein for receiving the card, and further defining a receiving cavity;

a contact module secured in the housing; and a card ejection mechanism received in the receiving cavity of the housing, the card ejection mechanism including:

an elastic element;

a slide block connecting with the elastic element, the slide block defining a fixing opening, the slide block being moved by the card and compressing the elastic element when the card is inserted into the connector;

a slide rod having first and second ends, the first end being secured in the fixing opening of the slide block; and a guiding structure formed in the housing of the connector, the guiding structure including a recess and an arcuate island formed in a middle of the recess, a protrusion formed by the housing protruding in the recess, the second end of the slide rod being slidably fitted in the recess.

2. The connector as claimed in claim 1, wherein the recess of the guiding structure of the card ejection mechanism has a generally sea horse shaped contour.

3. The connector as claimed in claim 1, wherein the card ejection mechanism further includes a lid covering the guiding structure for preventing the second end of the slide rod from escaping from the recess.

4. The connector as claimed in claim 1, wherein the card ejection mechanism further includes retaining means for securely retaining the card ejection mechanism in the housing.

5. The connector as claimed in claim 4, wherein the retaining means comprises a base and a pin, the base connecting with the elastic element such that the elastic element is disposed between the base and the slide block, the pin fitting in the housing and the base.

6. The connector as claimed in claim 1, wherein the elastic element is a compression spring.

7. The connector as claimed in claim 2, wherein the lid has a solder pad adapted for soldering to the printed circuit board.

8. The connector as claimed in claim 7, wherein the housing comprises a top wall and a bottom wall and lateral sides between the top and bottom walls, and the connector further comprises at least one further solder pad secured to at least one of the lateral sides of the housing.

9. The connector as claimed in claim 1, wherein the housing comprises a top wall and a bottom wall, the contact module being secured in the bottom wall of the housing.

10. The connector as claimed in claim 9, wherein the contact module includes first and second contact elements, the bottom wall defines a bottom opening, steps are formed in the bottom wall at a rear of the bottom opening, recesses are defined in the bottom wall forward of the steps, a rear portion of the first contact element abuts the steps, a rear portion of the second contact element abuts a front portion of the first contact element, and protrusions of the second contact element fit in the recesses.

11. The connector as claimed in claim 1, further comprising a detecting device for detecting whether the card is inserted into the connector, the detecting device comprising two contacts.

12. An electronic card connector comprising:

a housing defining a receiving space therein for receiving a subscriber identity module card, and further defining a receiving cavity;

a contact module secured in the housing; and ejection means received in the receiving cavity of the housing for facilitating ejection of the card, the ejection means including:

an elastic element;

a slide block connecting with the elastic element, the slide block defining a fixing opening, the slide block being moved by the card and compressing the elastic element when the card is inserted into the connector;

a slide rod having first and second ends, the first end being secured in the fixing opening of the slide block; and a guiding structure formed in the housing of the connector, the guiding structure including a recess and an arcuate island formed in a middle of the recess, a protrusion formed by the housing protruding in the recess, the second end of the slide rod being slidably fitted in the recess.

13. A method for assembling an electronic card connector, comprising the steps of:

a) providing a housing defining a receiving space therein for receiving a subscriber identity module card, and further defining a receiving cavity;

b) providing a card ejection mechanism received in the receiving cavity of the housing, the card ejection mechanism including an elastic element, a slide rod, a slide block, and a guiding structure formed in the housing, the guiding structure including a generally sea horse shaped recess and an arcuate island formed in a middle of the recess;

c) providing a contact module comprising two contact elements;

d) assembling the elastic element, the slide rod and the slide block;

e) inserting the assembly formed in step d) into the receiving cavity of the housing and putting a free end of the slide rod in the guiding structure; and f) securing the two contact elements in the housing in turn.

14. The method as claimed in claim 13, further comprising the step of providing a retaining assembly for locking the card ejection mechanism in the housing.

15. The method as claimed in claim 14, further comprising the step of assembling the retaining assembly to the assembly in step d).

16. The method as claimed in claim 13, further comprising the step of providing an opening in the housing corresponding to the guiding structure.

17. The method as claimed in claim 16, further comprising the step of putting a lid in the opening to cover the guiding structure.

18. The method as claimed in claim 13, further comprising the step of providing a detecting device.

19. The method as claimed in claim 18, further comprising the step of assembling the detecting device to the housing.

* * * * *